United States Patent [19]

Huhn et al.

[11] Patent Number: 4,720,520

[45] Date of Patent: Jan. 19, 1988

[54] METHOD FOR IMPREGNATING ORGANIC FIBERS

[75] Inventors: Karl Huhn; Ingomar Kovar, both of Burghausen, Fed. Rep. of Germany

[73] Assignee: Wacker-Chemie GmbH, Munich, Fed. Rep. of Germany

[21] Appl. No.: 39,811

[22] Filed: Apr. 9, 1987

Related U.S. Application Data

[63] Continuation of Ser. No. 807,007, Dec. 9, 1985, abandoned.

[30] Foreign Application Priority Data

Feb. 1, 1985 [DE] Fed. Rep. of Germany ..... 3503457

[51] Int. Cl.[4] ..... C08L 83/08

[52] U.S. Cl. ..... 524/838; 524/588; 524/861; 524/862; 427/387

[58] Field of Search ..... 524/838, 861, 862, 588; 427/387

[56] References Cited

U.S. PATENT DOCUMENTS

| | | | |
|---|---|---|---|
| 4,098,701 | 7/1978 | Burrill et al. | 252/8.6 |
| 4,436,856 | 3/1984 | Huhn et al. | 524/211 |
| 4,680,366 | 7/1987 | Tanaka et al. | 524/588 |

*Primary Examiner*—Lewis T. Jacobs

[57] ABSTRACT

A method for impregnating organic fibers which comprises applying a composition containing (1) an organopolysiloxane having silicon-bonded condensable groups and containing diorganosiloxane units in which the two SiC-bonded organic radicals are monovalent hydrocarbon radicals and also contains two monovalent SiC-bonded radicals having a basic nitrogen group; (2) an organopolysiloxane having at least 3 Si-bonded hydrogen atoms per molecule; and (3) a catalyst which promotes the condensation of the silicon-bonded condensable groups, in which the SiC-bonded radicals having a basic nitrogen group are present in the organopolysiloxane (1) as monoorganosiloxane units and as diorganosiloxane units.

3 Claims, No Drawings

METHOD FOR IMPREGNATING ORGANIC FIBERS

This is a continuation of application Ser. No. 807,007, filed Dec. 9, 1985, now abandoned.

The present invention relates to a method for impregnating organic fibers and more particularly to a method for impregnating organic fibers to impart a high degree of softness, a pleasant hand and resistance to shrinkage.

BACKGROUND OF THE INVENTION

Organic fibers have been impregnated with organopolysiloxanes containing condensable groups to improve crease resistance and dimensional stability. U.S. Pat. No. 4,098,701 to Burrill et al, for example, discloses treating organic fibers with a composition containing (A) an organopolysiloxane having diorganosiloxane units in which the two organic radicals are monovalent hydrocarbon radicals and further contains at least two monovalent SiC-bonded organic radicals having a basic nitrogen group per molecule, (B) an organopolysiloxane having at least three silicon-bonded hydrogen atoms per molecule and (C) a catalyst which promotes the condensation of Si-bonded condensable groups. U.S. Pat. No. 4,436,856 to Huhn et al discloses a process for impregnating organic fibers with an aqueous emulsion comprising (A) an organopolysiloxane containing diorganosiloxane units in which both organic radicals are monovalent hydrocarbon radicals and also contains at least two monovalent SiC-bonded organic radicals per molecule having a basic nitrogen atom, in which the SiC-bonded organic radicals containing the basic nitrogen atom are present in monoorganosiloxane units, (B) an organopolysiloxane having at least 3 Si-bonded hydrogen atoms per molecule, (C) a catalyst which promotes the condensation of Si-bonded condensable groups, (D) an emulsifier and (E) a diorganopolysiloxane containing an Si-bonded hydroxyl group in each of its terminal units and whose organic radicals are free of basic nitrogen atoms.

The above cited Burrill patent does not disclose any siloxane units having a basic nitrogen group, other than the diorganosiloxane units and in the Huhn patent, all the SiC-bonded radicals having basic nitrogen are present in the monoorganosiloxane units. Thus, neither the Burrill patent nor the Huhn patent disclose a method for impregnating organic fibers with a composition containing an organopolysiloxane, in which the SiC-bonded radicals containing a basic nitrogen group are present in both the monoorganosiloxane units and the diorganosiloxane units.

Therefore, it is an object of the present invention to provide a method for impregnating organic fibers. Another object of the present invention is to provide a method for impregnating organic fibers which imparts to the fibers a high degree of softness and a pleasant hand. Another object of the present invention is to provide a method for impregnating organic fibers which imparts to the fibers elasticity, recovery properties and resistance to shrinkage. A further object of the present invention is to provide a method for impregnating organic fibers which imparts to the fibers excellent sewing properties. A still further object of the present invention is to provide a method for impregnating organic fibers which will retain the above properties even after they have been cleaned with water or organic solvents.

SUMMARY OF THE INVENTION

The foregoing objects and others which will become apparent from the following description are accomplished in accordance with this invention, generally speaking, by providing a method for impregnating organic fibers which comprises applying to the organic fibers a composition containing (1) an organopolysiloxane having condensable groups bonded directly to silicon atoms, and containing diorganosiloxane units in which the two SiC-bonded organic radicals are monovalent hydrocarbon radicals and at least two monovalent SiC-bonded radicals contain a basic nitrogen group, in which the SiC-bonded radicals having a basic nitrogen group are present in both the monoorganosiloxane units and the diorganosiloxane units; (2) an organopolysiloxane having at least three Si-bonded hydrogen atoms per molecule; and (3) a catalyst which promotes the condensation of the condensable groups bonded to the silicon atoms.

DESCRIPTION OF THE INVENTION

It is now possible by the method of this invention to impregnate all organic fibers, regardless of whether they are in the form of yarns, fleeces, mats, skeins, woven or knitted textiles, which have been or could have been impregnated heretofore with organosilicon compounds. Examples of fibers which may be impregnated by the method of this invention are those consisting of keratin, especially wool, polyvinyl alcohol, copolymers of vinyl acetate, cotton, rayon, hemp, natural silk, polyethylene, polypropylene, polyester, polyurethane, polyamide, cellulose and mixtures containing at least two such fibers. The fibers may be of either natural or synthetic origin and the textiles may be present in the form of fabric bolts or clothing articles or parts of clothing articles.

Impregnating keratin, especially wool, by the method of this invention makes it possible to prevent shrinkage because of felting, especially when the keratin has been pretreated with chlorine, followed by rinsing and neutralization.

The diorganosiloxane units in the organopolysiloxane (1) wherein the two SiC-bonded organic radicals are monovalent hydrocarbon radicals, are preferably those which can be represented by the formula:

$$R_2Si(OR^1)_a\frac{O_{2-a}}{2}$$

where R represents the same or different monovalent hydrocarbon radicals, $R^1$ represents hydrogen or radicals having from 1 to 15 carbon atoms per radical which consist of carbon and hydrogen atoms and may consist of an ether oxygen atom and which are free of multiple bonds, and a is 0 or 1.

It is preferred that the R radicals have from 1 to 18 carbon atoms per radical. Examples of suitable R radicals are alkyl radicals, such as the methyl, ethyl, n-propyl and ispropyl radicals, as well as butyl, octyl, tetradecyl and octadecyl radicals; aliphatic hydrocarbon radicals having at least one double bond, such as the vinyl, allyl and the butadienyl radical; cycloaliphatic hydrocarbon radicals, such as the cyclohexyl radical; aromatic hydrocarbon radicals such as the phenyl and the naphthyl radicals; alkaryl radicals such as the tolyl radical; and aralkyl radicals such as the benzyl radical.

It is preferred that at least 80 percent of the number of SiC-bonded hydrocarbon radicals in the organopolysiloxane (1) be methyl radicals because of their availability.

The examples provided above for the hydrocarbon radicals represented by R are equally applicable to the hydrocarbon radicals represented by $R^1$, provided that the hydrocarbon radicals represented by $R^1$ are free of aliphatic multiple bonds and that they contain no more than 15 carbon atoms per radical. Preferred hydrocarbon radicals representing $R^1$ are methyl, ethyl and isopropyl radicals. An example of an $R^1$ radical which consists of carbon and hydrogen atoms and which is preferred, is a radical having the formula $$CH_3O(CH_2)_2—.$$

It is preferred that the organopolysiloxanes (1) contain at least 100 diorganosiloxane units per molecule in which the two SiC-bonded organic radicals are monovalent hydrocarbon radicals.

The monoorganosiloxane units having the SiC-bonded radicals with a basic nitrogen group which are present in the organopolysiloxane (1), are preferably those having the formula $$R^2{}_2NR^3Si(OR^1)_b\frac{O_{3-b}}{2},$$

while the diorganosiloxane units having SiC-bonded radicals with a basic nitrogen group, which are present in the organopolysiloxane (1), are preferably those of the formula $$R^2{}_2NR^3RSi(OR^1)_a\frac{O_{2-a}}{2}$$

where R, $R^1$ and a are the same as above, $R^2$ represents hydrogen or the same or different alkyl or aminoalkyl or iminoalkyl radicals, $R^3$ represents the same or different divalent hydrocarbon radicals, and b is 0, 1 or 2.

The examples provided for the alkyl radicals represented by R are equally applicable to the alkyl radicals represented by $R^2$.

Examples of aminoalkyl radicals represented by $R^2$ are those having the formulas $$H_2N(CH_2)_2—$$

$$H_2N(CH_2)_2NH(CH_2)_3—$$

$$H_2N(CH_2)_3—$$

$$(CH_3)_2N(CH_2)—$$

$$H_2N(CH_2)_5—$$

$$H(NHCH_2CH_2)_3—$$

$$n—C_4H_9NHCH_2CH_2NHCH_2CH_2—.$$

Because of their availability, it is preferred that the $R^3$ radical have the formula $$—(CH_2)_3—.$$

Additional examples of $R^3$ radicals are those of the formulas $$—CH_2—$$

$$—(CH_2)_2—$$

$$—(CH_2)_4—$$

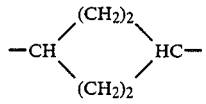

$$—CH_2CH(CH_3)CH_2—$$

$$—C_6H_4— \text{ and}$$

$$—CH_2CH{=}CHCH_2—.$$

In order that the SiC-bonded radicals having a basic nitrogen group in the organopolysiloxane (1) be present in the form of monoorganosiloxane units and diorganosiloxane units, it is necessary that the organopolysiloxane (1) or the organopolysiloxanes (1) comprise at least one monoorganosiloxane unit having an SiC-bonded radical with a basic nitrogen group and at least one diorganosiloxane unit having an SiC-bonded radical with a basic nitrogen group, although it is sufficient that one of these units be present for each molecule of the organopolysiloxane (1).

It is preferred that the sum of the number of monorganosiloxane units having an SiC-bonded radical with a basic nitrogen group and the number of diorganosiloxane units having an SiC-bonded radical with a basic nitrogen group, represent no more than about 20 percent of the total number of diorganosiloxane units, in which the two SiC-bonded organic radicals are monovalent hydrocarbon radicals, in order to prevent yellowing of the impregnated fibers.

It is preferred that the ratio between the number of monoorganosiloxane units having a basic nitrogen group and the number of diorganosiloxane units having a basic nitrogen group be between 0.9:3 and 3:1, and more preferably between 0.9:1 and 1.1:1.

It is preferred that the organopolysiloxane (1) or a mixture comprising at least two different varieties of the organopolysiloxane (1) have an average viscosity of from 100 to 100,000 mPa.s at 25° C.

The organopolysiloxanes (1) may be prepared by any method that is suitable for the preparation of organopolysiloxanes having SiC-bonded radicals with a basic nitrogen group.

The organopolysiloxanes (2) comprising at least three Si-bonded hydrogen atoms per molecule used in the method of this invention, may be the same organopolysiloxanes which have been or could have been used heretofore in processes for impregnating organic fibers that utilize organopolysiloxanes having at least three Si-bonded hydrogen atoms per molecule.

In the organopolysiloxanes (2) containing at least three Si-bonded hydrogen atoms per molecule, the silicon valences which are satisfied by atoms other than hydrogen and siloxane oxygen atoms are preferably satisfied by methyl, ethyl or phenyl radicals or a mixture containing at least two such hydrocarbon radicals. Furthermore, it is preferred that a hydrocarbon radical be bonded to each silicon atom that is bonded to a hydrogen atom.

The preferred organopolysiloxanes (2), containing at least three Si-bonded hydrogen atoms per molecule, are those of the formula $$(CH_3)_3SiO(SiR_2^4O)_pSi(CH_3)_3,$$

where $R^4$ represents hydrogen or the methyl, ethyl or phenyl radical and p is an integer having a value of from 10 to 500, with the proviso that no more than one hydrogen atom may be bonded to each silicon atom and that the ratio of $R_2^4SiO$ units where both $R^4$ radicals represent hydrocarbon radicals to the number of Si-bonded units must be 0:1 to 4:1. It is preferred that the $R^4$ radical represent a methyl radical, unless it is hydrogen.

In the organopolysiloxanes (2), containing at least three Si-bonded hydrogen atoms per molecule, it is possible to use the same or different molecules of this type or organopolysiloxane.

In the method of this invention, the organopolysiloxane (2) having at least three Si-bonded hydrogen atoms per molecule, may be used in the same quantities in which it was used in the methods used heretofore for impregnating organic fibers in combination with organopolysiloxanes having silicon-bonded condensable groups. It is preferred that such an organopolysiloxane be employed in an amount of from about 0.01 to about 0.50 parts by weight of Si-bonded hydrogen for each 100 parts by weight of the organopolysiloxane (1).

The same catalysts which have been or could have been used heretofore for promoting the condensation of condensable groups bonded to silicon may be used as catalysts (3) in this invention for promoting the condensation of condensable groups bonded to silicon atoms. Examples of such catalysts are carboxylic acid salts of tin or zinc. The hydrocarbon radicals may be bonded directly to tin, such as in di-n-butyltin dilaurate, tin octoate, di-2-ethyltin-dilaurate, di-n-butyltin di-2-ethylhexoate, di-2-ethylhexyltin di-2-ethylhexoate, and dibutyl or dioctyltin diacylate, where the acyl groups are derived from alkane acids having from 3 to 16 carbon atoms per acid, in which at least two of the valences of the carbon atoms bonded to the carboxyl group are satisfied by at least two carbon atoms other than the carbon atom of the carboxy group, in addition to zinc octoate. Additional examples of catalysts (3) are alkoxytitanates, such as butyltitanate and triethanolaminotitanate, and zirconium compounds.

The same or different molecules of this type of catalyst may be used as catalysts (3).

In the method of this invention, catalysts (3) may be employed in the same amounts which have been or could have been employed heretofore to promote the condensation of silicon-bonded condensable groups. It is preferred that catalyst (3) be used in an amount of from 1 to 10 parts by weight for each 100 parts by weight of the organopolysiloxane (1).

In addition to the substances described above, such as the organopolysiloxane (1), organopolysiloxane (2) and catalyst (3), the composition may also include additional substances which have been or could have been employed heretofore in compositions for impregnating organic fibers. Examples of such additional substances are dimethylpolysiloxanes containing an Si-bonded hydroxyl group in their terminal units and having a viscosity up to about 10,000 mPa.s at 25° C. Other substances which may be employed when the fibers to be impregnated consist at least partially of cellulose or cotton, are the so-called "wrinkle-proof" finishes, such as dimethyldihydroxyethyleneurea (DMDHEU), which is mixed with zinc nitrate or magnesium chloride.

The substances used in the method of this invention may be applied to the fibers which are to be impregnated in undiluted form or in the form of solutions in an organic solvent or in the form of aqueous emulsions. When aqueous emulsions are employed, the emulsions may contain not only water, but may include dispersants, thickeners such as poly-N-vinylpyrrolidine, as well as the substances mentioned above. It is preferred that the substances used in the method of this invention be applied to the fibers in the form of aqueous emulsions. Preferred dispersing agents are nonionogenic and cationogenic emulsifiers. These emulsions may be prepared via conventional methods for the emulsification of organopolysiloxanes.

The application of the substances of this invention to the fibers which are to be impregnated may take place by any of the heretofore known methods for impregnating fibers, such as, for example, by immersion, coating, pouring, spraying, including aerosol spraying, rolling, padding or printing.

Preferably, the compositions used in accordance with this invention are applied in an amount which increases the weight of the treated fibers by from about 1 to about 20 percent by weight, based on the weight of fibers, and minus the diluents which are optionally employed.

The crosslinking of the organosilicon compounds on the fibers generally occurs at room temperature. However, it can be accelerated by heating to a temperature of from about 50° C. to about 180° C.

In the following examples, all parts and percentages are by weight, unless otherwise specified.

EXAMPLE 1

(a) A mixture consisting of one part of a silane having the formula $$H_2N(CH_2)_2NH(CH_2)_3Si(CH_3)(OCH_2)_2$$

one part of a silane having the formula $$H_2N(CH_2)_2NH(CH_2)_3Si(OCH_3)_3,$$

160 parts of a mixture containing cyclic dimethylpolysiloxanes having from 3 to 10 siloxane units per molecule, and 0.03 parts of a 40 percent solution of benzyltrimethylammonium hydroxide in methanol, is heated for 4 hours under nitrogen and with agitation to a temperature of 80° C. The ammonium hydroxide is neutralized by heating to 150° C. at 13 hPa (abs.) for 60 minutes while simultaneously removing the volatile components from the organopolysiloxane. The resultant organopolysiloxane contains silicon bonded methoxy groups as the condensable groups, and in addition contains monoorganosiloxane units and diorganosiloxane units having a basic nitrogen as well as dimethylsiloxane units. The viscosity of the product is 7,400 $mm^2.s^{-1}$ at 25° C.

(b) About 35 parts of the organopolysiloxane prepared in (a) above are emulsified in 61 parts of water with 2 parts of polyglycol ether which is obtained from the reacton of about 1 mole of isotridecanol with about 10 moles of ethylene oxide, and 2 parts of stearyldimethylbenzylammonium chloride as the dispersing agent.

(c) About 35 parts of methylhydrogenpolysiloxane having 1.6 percent of Si-bonded hydrogen and having a viscosity of 21 $mm^2.s^{-1}$ at 25° C., and 3 parts of polyglycol ether which is prepared by reacting about 1 mole of nonylphenyl with about 10 moles of ethylene oxide as a dispersing agent are emulsified in 61.9 parts of water and 0.1 part of glacial acetic acid.

(d) about 25 parts of di-n-butyltin dilaurate are emulsified in 72 parts of water with the aid of 3 parts of polyglycol ether which is obtained from the reaction of about 1 mole of nonylphenol with about 10 moles of ethylene oxide as a dispersant.

(e) A polyamide fabric having a weight of 180 g/m$^2$ is immersed in an emulsion containing:

50 g/liter of the emulsion prepared in (b) above;

2.5 g/liter of the emulsion prepared in (c) above;

2.5 g/liter of the emulsion prepared in (d) above; and the remainder of the emulsion is water. The fabric is subsequently squeezed until the weight of the liquid absorbed thereon is equal to about 90 percent of the weight of the fabric. The impregnated fabric is then heated for 5 minutes at 150° C.

The impregnated fabric exhibits a soft, elastic hand and has outstanding recovery properties. These desirable characteristics are maintained even after washing the fabric 5 times in a home washing machine at a temperature of 40° C.

EXAMPLE 2

A fabric consisting of 50 percent cotton and 50 percent polyester and having a weight of 210 g/m$^2$ is immersed in an emulsion containing:

40 g/liter of the emulsion described in Example 1(b);

4 g/liter of the emulsion described in Example 1(c);

4 g/liter of the emulsion described in Example 1(d);

80 g/liter of dimethyldihydroxyethyleneurea (DMDHEU);

10 g/liter of magnesium chloride;

and the remainder of the emulsion is water. The fabric is then squeezed until the weight of the fluid absorbed is equal to 80 percent of the weight of the fabric. The impregnated fabric is then heated for 10 minutes at 150° C.

The impregnated fabric exhibits a soft, elastic hand which is preserved even after washing 5 times in a home washing machine at 60° C.

EXAMPLE 3

(a) The method described in Example 1(a) is repeated, except that 3 parts of the silane having the formula $$H_2N(CH_2)_2NH(CH_2)_3Si(CH_3)(OCH_3)_2$$

are used instead of one part of said silane and 100 parts of the mixture of cyclic dimethylpolysiloxanes having from 3 to 10 siloxane units per molecule are used instead of 160 parts of the mixture.

(b) The method described in Example 1(b) is repeated, except that 35 parts of the organopolysiloxane described in Example 3(a) are used instead of the organopolysiloxane described in Example 1(a).

(c) A wool fabric weighing 400 g/m$^2$ is immersed in an emulsion containing:

50 g/liter of the emulsion prepared in Example 3(b);

1 g/liter of the emulsion prepared in Example 1(c);

1 g/liter of the emulsion prepared in Example 1(d);

with the remainder of the emulsion being water. The fabric is then squeezed until the weight of the fluid absorbed by the fabric is equal to the weight of the fabric. The impregnated fabric is then heated for 10 minutes at 150° C. The impregnated fabric exhibits a soft elastic hand and after washing in a home washing machine at 30° C., its dimensions remain stable.

COMPARISON EXAMPLE $V_1$ (1) The method described in Example 1(b) for preparing the emulsion is repeated, except that 35 parts of the organopolysiloxane described in Example 1 of U.S. Pat. No. 4,098,701, are substituted for the 35 parts of the organopolysiloxane used in Example 1(b).

(2) The method described in Example 1(e) is repeated, except that 50 g/liter of the emulsion described in Example (2) above are substituted for the 50 g/liter of the emulsion described in Example 1(b).

COMPARISON EXAMPLE $V_2$ (U.S. Pat. No. 4,436,856)

(3) The method described in Example 1(b) is repeated, except that the following are substituted for the 35 parts of organopolysiloxane used in Example 1(b):

30 parts of a dimethylpolysiloxane having an Si-bonded hydroxyl group in each of its terminal units and having a viscosity of 6,000 mPa.s at 25° C.; and 5 parts of the product obtained from the reaction of a dimethylpolysiloxane containing an Si-bonded hydroxyl group in each of its terminal units and having a viscosity of 100 mPa.s at 25° C., and a silane having the formula $$H_2N(CH_2)_2NH(CH)_2)_3Si(OCH_3)_3,$$

in which the amine value of the reaction product is 0.5 and its viscosity is 160 mPa.s at 25° C.

(4) The method described in Example 1 is repeated, except that 50 g/liter of the emulsion described in Example (3) above is substituted for the 50 g/liter of the emulsion described in Example 1(b).

The fabrics impregnated according to Example 1 and the fabrics impregnated in accordance with the Comparison Examples were evaluated by nine individuals who did not know which fabrics were impregnated according to the comparison examples and which fabrics were impregnated by the method of Example 1. The evaluation took place both before and after the fabrics had been washed 5 times in a home washing machine at 40° C. Five individuals preferred the hand of the fabrics impregnated by the method of Example 1, while two groups of two persons each preferred the hand of the fabrics impregnated by the methods of the comparison examples.

What is claimed is:

1. A method for impregnating organic fibers which comprises applying a composition containing (1) an organopolysiloxane having silicon-bonded condensable groups and diorganosiloxane units having two SiC-bonded monovalent hydrocarbon radicals and at least two monovalent SiC-bonded radicals having a basic nitrogen group in which the basic nitrogen groups are present in both monoorganosiloxane units and diorganosiloxane units of the same molecule and the sum of the number of monoorganosiloxane units and diorganosiloxane units having SiC-bonded radicals with basic nitrogen groups does not exceed about 20 percent of the total number of diorganosiloxane units; (2) an organopolysiloxane having at least three Si-bonded hydrogen atoms per molecule; and (3) a catalyst which promotes the condensation of the condensable groups.

2. The method of claim 1, wherein the ratio between the number of monoorganosiloxane units having a basic nitrogen group and the number of the diorganosiloxane units having the basic nitrogen group is between 0.1:3 and 3:1.

3. The method of claim 1, wherein the ratio between the number of monoorganosiloxane units having a basic nitrogen group and the number of diorganosiloxane units having the basic nitrogen group is between 0.9:1 and 1.1:1.

* * * * *